United States Patent [19]

DeKeyser et al.

[11] 4,222,713

[45] Sep. 16, 1980

[54] TEMPERATURE RESPONSIVE FUEL COMPENSATOR

[75] Inventors: Richard A. DeKeyser, Edelstein; Robert H. Miller, Peoria, both of Ill.

[73] Assignee: Caterpillar Tractor Co., Peoria, Ill.

[21] Appl. No.: 43,182

[22] Filed: May 29, 1979

[51] Int. Cl.[3] ..... F04B 49/00

[52] U.S. Cl. ..... 417/214; 417/292; 123/381

[58] Field of Search ..... 417/292, 213, 214, 212; 123/140, 140 FG

[56] References Cited

U.S. PATENT DOCUMENTS

| | | | |
|---|---|---|---|
| 3,311,100 | 3/1967 | Maddalozzo | 123/140 R |
| 3,313,530 | 4/1967 | Bickhaus | 417/292 |
| 3,313,531 | 4/1967 | Winkley | 417/292 |
| 3,628,892 | 12/1971 | Eheim | 417/292 |
| 3,847,127 | 11/1974 | Staudt | 123/140 R |

*Primary Examiner*—Robert W. Jenkins
*Attorney, Agent, or Firm*—James R. Bell

[57] ABSTRACT

Adjustments are preset to factory specifications, during assembly of a vehicle engine, which limit the maximum amount of fuel, per stroke, being injected by each injection pump. Because of these preset adjustments, an increase in fuel temperature above a critical point can cause a power loss. A compensator (30) is provided to vary the preset adjustments. The compensator includes a member (70) which responds to fuel temperature increase and permits more volume of fuel per stroke to be injected by each injection pump.

7 Claims, 3 Drawing Figures

FIG. 1
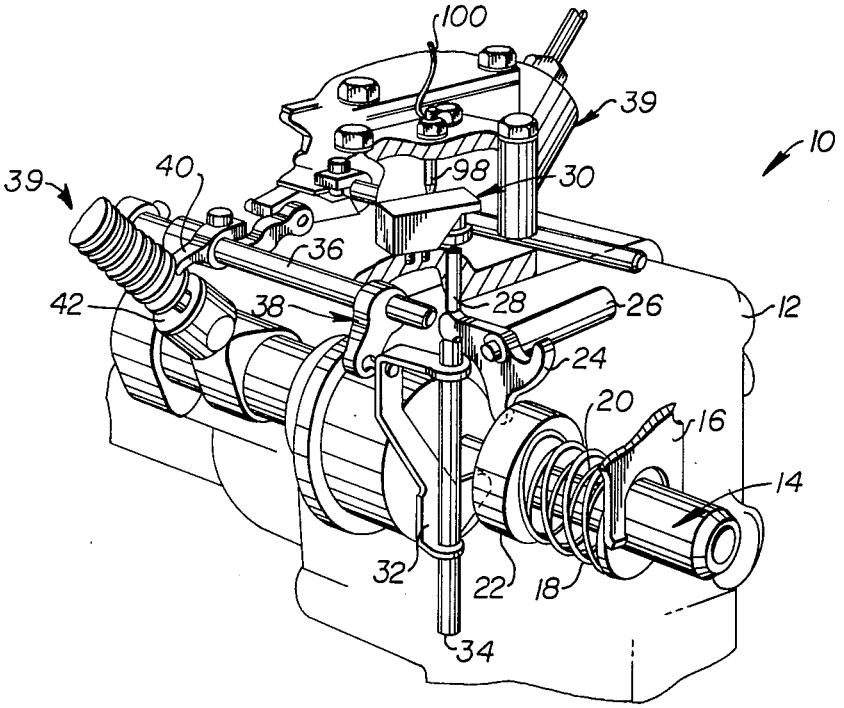
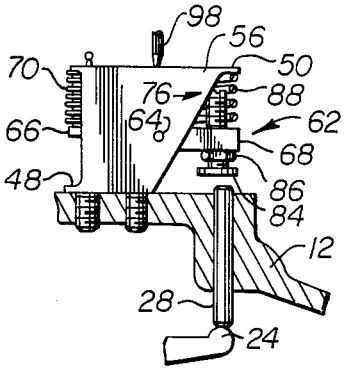
FIG. 2
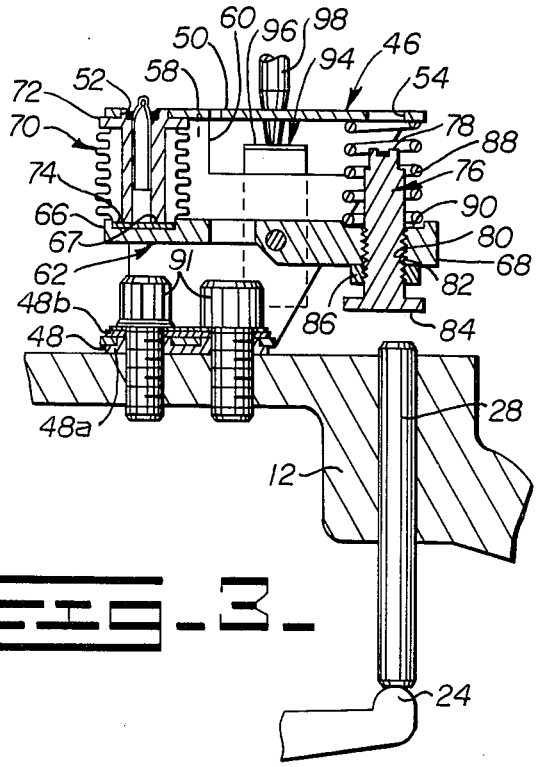
FIG. 3

TEMPERATURE RESPONSIVE FUEL COMPENSATOR

DESCRIPTION

1. Technical Field

This invention relates generally to internal combustion engines and more particularly to accessories such as fuel pumps.

2. Background Art

During the operation of a vehicle there is an increase in the temperature of the fuel used by that vehicle. This temperature increase is due to an increase in the operating temperature of the vehicle engine. Also, the fuel temperature is affected by the outside air temperature. Thus, on a hot day, the fuel temperature may increase significantly.

Increase in fuel temperature can have a detrimental effect on the operation of a vehicle. When fuel temperature increases, its volume increases and its fuel density decreases. The result is that there is less mass of fuel represented in each unit volume which is metered to the engine. When fuel density decreases, the vehicle can experience a power loss.

A governor is provided to maintain given RPM value in response to a power requirement. A metering device is provided to control the amount of fuel supplied to cylinders in a vehicle engine. Adjustments are preset to factory specifications during assembly of an engine which limit movement of the governor and the metering device during engine operation. Compensation for these preset adjustments, as relates to power requirements, would preclude power losses due to fuel temperature increases.

In view of the above, it would be advantageous to provide a compensator for maintaining a substantially constant density of fuel metered to the engine which overcomes the problems associated with the prior art.

DISCLOSURE OF INVENTION

In one aspect of the present invention, the problems pertaining to the known prior art, as set forth above, are advantageously avoided.

This is accomplished by providing a temperature responsive fuel compensator including a member which is temperature responsive for movement in a first direction as temperature increases. A second member is resiliently biased in the first direction. Means are provided for moving the second member in a second direction opposite the first direction in response to movement of the first member in the first direction.

The foregoing and other advantages will become apparent from the following detailed description of the invention when considered in conjuction with the accompanying drawings. It is to be expressly understood, however, that the drawings are not intended as a definition of the invention but are for the purpose of illustration only.

BRIEF DESCRIPTION OF THE DRAWINGS

In the drawings:

FIG. 1 is an isometric view illustrating the compensator mounted in a fuel pump housing;

FIG. 2 is a side elevational view illustrating the compensator of this invention; and FIG. 3 is an enlarged cross-sectional view further illustrating the compensator of this invention.

BEST MODE FOR CARRYING OUT THE INVENTION

A sleeve metering fuel system is partially shown in FIG. 1 and is generally designated 10. The system comprises a housing 12 filled with fuel received from a fuel transfer pump (not shown). Full load pressure of the fuel in housing 12 is about 30±5 psi (205±35 kPa).

A governor 14 is actuated by a lever 16 and includes springs 18,20 and a spring seat 22. Thus, movement of lever 16, to provide more fuel to the engine (not shown), will put springs 18,20 in compression and move spring seat 22. Spring seat 22 moves a load stop lever 24 pivoting about a pivot pin 26 for moving a load stop pin 28 upward, as viewed in FIG. 1, against a novel compensating stop generally designated 30. Stop 30 is preset during engine manufacture and is mounted in housing 12.

Also, spring seat 22 moves a control lever 32 pivotally mounted on a pivot pin 34 for actuating a metering sleeve control shaft 36 in rotation due to a connecting linkage 38. Rotation of shaft 36 actuates a lever 40 for controlling a plurality of fuel injection pumps partially shown and designated 39, including a sleeve 42. Thus, rotation of shaft 36 and movement of spring seat 22 is limited by stop 30 which limits the maximum amount of fuel per stroke being injected by each injection pump.

Since stop 30 limits the maximum amount of fuel being injected, movement of repositioning of the stop can alter the maximum amount of fuel being injected.

Stop 30, FIGS. 1, 2, 3, comprises a novel temperature responsive fuel compensator including a housing 46 preferably of stainless steel. Housing 46 includes a base 48, a top 50 having openings 52,54 formed therein, a front wall 56 and a back wall 58 having an opening 60 formed therein.

A lever 62, preferably stainless steel, is mounted in housing 46 between front and back walls 56,58 for pivoting about dowel 64 which extends through the walls 56,58 and the lever 62. Dowel 64 is also preferably of stainless steel. Lever 62 has a first portion 66 and a second portion 68.

A first member such as a bellows 70 is mounted in housing 46. Bellows 70 has a first end 72 abutting housing 46 adjacent opening 52 and has a second end 74 abutting first lever portion 66 and seated in seat 67. Bellows 70 is responsive for expansive movement in a first direction toward base 48 in response to an increase in temperature of the fuel which fills housing 12. Bellows 70 is preferably part number 85254-AL COPPER-BERYLLIUM THERMAL BELLOWS sold by the FULTON SYLPHON DIVISON OF ROBERT SHAW CONTROLS CO. Bellows 70 is charged solid with FREON F-113 and then sealed. It has been found that power losses are experienced when the fuel is at a critical temperature of about 120 degrees F. (50 degrees C.) and above. Therefore, bellows 70 is provided to expand at and above the critical temperature. As a result, elements within preset stop 30 are moved to increase the maximum amount of fuel per stroke, being injected by each injection pump when the fuel is at critical temperature.

A second member, such as a stop 76, preferably stainless steel, is threadably adjustably mounted in second portion 68 of lever 62. Stop 76 includes an adjustment end 78, a threaded shaft 80 received by threaded opening 82 in lever 62, and a stop end 84. A standard jam nut 86, threaded on shaft 80 fixes the position of stop end 84 where desired for limiting movement of load stop pin 28 as discussed above.

Stop 76 is resiliently biased in the first direction by a stainless steel compression spring 88 compressed between top 50 and second portion 68 of lever 62. Spring 88 seats in spring seat 90 formed in lever 62. Spring 88 is of a construction sufficient for resisting compression due to forces imposed on stop 76 by load stop pin 28, but may be compressed by lever 62 moving stop 76 in a second direction, opposite the first direction, toward top 50 in response to expansion of bellows 70 toward base 48. In this manner, lever 62 functions as a means for interconnecting stop 76 and bellows 70 and for moving stop 76 in response to movement of bellows 70.

Housing 46 is mounted in housing 12 by standard threaded fasteners 91 extending through base 48. Housing 46 is electrically insulated from housing 12 by insulators 48*a* and 48*b*, preferably formed of PLASKON PHENALL 8000 and sold by ALLIED CHEMICAL CORP.

A stainless steel contact 94 is connected to back wall 58 of housing 46 and contact end 96 extends into opening 60. A signalling device 98 engages contact end 96 and when load stop pin 28 contacts stop end 84, a circuit is completed which actuates a signal indicator on an associated vehicle (not shown) through connecting wires 100, in the well known manner.

INDUSTRIAL APPLICABILITY

With the parts assembled as set forth above, it can be seen that at about the critical temperature, as described above, bellows 70 will expand and urge portion 66 of lever 62 in a first direction toward base 48 of housing 46. As a result, lever 62 pivots at dowel 64 and portion 68 is moved in a second direction toward top 50 of housing 46. Since stop 76 is secured in second portion 68, stop 76 also moves in the second direction compressing spring 88 between portion 68 of lever 62 and top 50 of housing 46. This raises stop end 84 permitting greater movement of stop pin 28, lever 24, lever 32, metering sleeve control shaft 36, lever 40 and metering sleeve 42. Thus, there is an increase in the maximum amount of fuel per stroke, being injected by each injection pump 39, related to a corresponding increase in fuel temperature. When fuel temperature decreases below the critical temperature, the bellows 70 contacts and stop end 84 eventually returns to a position corresponding to the position preset during manufacture.

The foregoing has described a temperature responsive fuel compensator including a member which moves in response to an increase in fuel temperature.

Other aspects, objects and advantages of this invention can be obtained from a study of the drawings, the disclosure and the appended claims.

What is claimed is:

1. A temperature responsive fuel compensator apparatus (30) comprising:

a first member (70), said first member being temperature responsive for movement in a first direction in response to a temperature increase;

a second member (76), said second member being resiliently biased in said first direction; and means (62) for moving said second member (76) in a second direction opposite said first direction in response to movement of said first member (70) in said first direction, said means (62) interconnecting said first and second members (70,76).

2. The apparatus of claim 1 wherein said second member (76) is adjustable relative to said first member (70) and said means (62).

3. The apparatus of claim 1 wherein said first member (70) is a bellows (70) of construction sufficient for expanding in response to an increase in temperature.

4. The apparatus of claim 1 including:

a compensator housing (46), said first and second members (70,76) and said means (62) being mounted in said compensator housing (46).

5. The apparatus of claim 4 wherein said means (62) is pivotally mounted in said compensator housing (46), a first end (66) of said means being connected to said first member (70) and a second end (68) of said means being connected to said second member (76).

6. The apparatus of claim 5 including:

a resilient member (88) mounted between said second end (68) and said housing (46).

7. A temperature responsive fuel compensator apparatus (30) comprising:

a housing (46);

a bellows (70) mounted in said housing (46), said bellows (70) having first and second ends (72,74), said first end (72) being connected to said housing (46);

a lever (62), said lever (62) pivotally mounted in said housing (46) and having first and second portions (66,68), said first portion (66) being adjacent said second end (74) of said bellows (70);

a stop member (76), said stop member (76) being adjustably mounted in said second portion (68) of said lever (62); and a resilient member (88) between said second portion (68) and said housing (46).

* * * * *